US007614711B2

(12) United States Patent
Mataki

(10) Patent No.: US 7,614,711 B2
(45) Date of Patent: Nov. 10, 2009

(54) LIQUID DROPLET EJECTION METHOD AND LIQUID DROPLET EJECTION APPARATUS

(75) Inventor: Hiroshi Mataki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 490 days.

(21) Appl. No.: 11/489,503

(22) Filed: Jul. 20, 2006

(65) Prior Publication Data

US 2007/0019041 A1 Jan. 25, 2007

(30) Foreign Application Priority Data

Jul. 22, 2005 (JP) ..... 2005-212963

(51) Int. Cl.
*B41J 29/38* (2006.01)
*B41J 2/045* (2006.01)

(52) U.S. Cl. ..... 347/10; 347/68

(58) Field of Classification Search ..... 347/9–11, 347/68

See application file for complete search history.

(56) References Cited

U.S. PATENT DOCUMENTS 6,962,398 B2 * 11/2005 Okuda et al. ..... 347/10
2003/0016270 A1 1/2003 Kubota et al.
2003/0202079 A1 * 10/2003 Hirai ..... 347/99

FOREIGN PATENT DOCUMENTS

JP 2003-25577 A 1/2003
JP 2004-306537 A 11/2004

* cited by examiner

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

A liquid droplet ejection apparatus comprises: a nozzle from which a liquid droplet is ejected; a pressure chamber filled with liquid to which a pressure is applied in order to eject the liquid in a form of the liquid droplet from the nozzle; and a supply port which supplies the liquid to the pressure chamber, wherein inertance Mn of the nozzle, resistance Rn of the nozzle, compliance Cn of a nozzle section due to surface tension, inertance Ms of the supply port, and resistance Rs of the supply port satisfy the following two formulas:

$$\frac{1}{Mn+Ms}\sqrt{\frac{Mn+Ms}{Cn}-\frac{(Rn+Rs)^2}{4}} > \pi f - \frac{Rn+Rs}{2(Mn+Ms)} \times \frac{1}{f} < \log 0.01.$$

3 Claims, 7 Drawing Sheets

LIQUID DROPLET EJECTION METHOD AND LIQUID DROPLET EJECTION APPARATUS

BACKGROUND OF THE INVENTION

1. Field of the Invention

The present invention relates to a liquid droplet ejection method and a liquid droplet ejection apparatus, and more particularly, to an inkjet type of liquid droplet ejection method and an inkjet type of liquid droplet ejection apparatus for ejecting a liquid in the form of a liquid droplet by applying ejection energy to the liquid.

2. Description of the Related Art

An inkjet type of liquid droplet ejection apparatus is known, which forms an image, or the like, by ejecting a liquid, such as ink, in the form of liquid droplets, from nozzles formed in the liquid droplet ejection head toward a recording medium. There are various different methods for the liquid droplet ejection method in an inkjet type of liquid droplet ejection apparatus, and known methods include: a piezoelectric method in which the volume of a pressure chamber is changed by deformation of a piezoelectric ceramic, ink is introduced into the pressure chamber from the ink supply channel when the volume is increased, and the ink inside the pressure chamber is ejected from the nozzle in the form of a liquid droplet when the volume of the pressure chamber decreases; and a thermal inkjet method where an air bubble which is generated by momentarily boiling ink by means of a heater or other electrical-thermal conversion elements, grows rapidly and thereby an ink droplet is ejected at high speed from a nozzle.

In an inkjet type of liquid droplet ejection apparatus of this kind, it is necessary that, once a liquid droplet has been ejected, the liquid that is to be ejected next is immediately supplied (refilled) in such a manner that the ejection can be stably performed at high speed, at all times.

For example, Japanese Patent Application Publication No. 2003-25577 discloses a thermal inkjet type of liquid ejection head for improving the liquid droplet ejection efficiency as well as the refill efficiency simultaneously. In the thermal inkjet type of liquid ejection head, values of the inertance from an ejection energy generation element (electrical-thermal conversion element) to an ejection port (nozzle), the inertance from the ejection energy generation element to a supply port, and the inertance of the whole flow channel comprising the nozzles and a supply chamber are set.

Furthermore, for example, Japanese Patent Application Publication No. 2004-306537 discloses a piezoelectric type of liquid ejection head for preventing consecutive occurrence of nozzles suffering ejection failure and enabling image recording at high speed. In the piezoelectric type of liquid ejection head, relationships of the flow channel resistances of a liquid supply channel, a liquid supply system, the nozzles and liquid chambers, and the overall inertance from a liquid tank up to the nozzles are established.

If the refilling characteristics are taken into account, then it is necessary to consider both of the viscosity and the inertia (inertance), in order to ascertain the ease of movement of the liquid. In Japanese Patent Application Publication No. 2003-25577 or Japanese Patent Application Publication No. 2004-306537, the values of the inertance and the flow channel resistances are set in order to improve refilling efficiency and increase the speed of recording.

On the other hand, there is a phenomenon whereby residual vibration of the meniscus remains due to the surface tension, after ejection of liquid, and these residual vibrations have an adverse effect on the next liquid ejection action. If the ejection frequency is low, then there is a spare time margin until the next liquid ejection action, and therefore, by introducing a drive waveform for stabilizing the meniscus surface by suppressing the vibration due to surface tension, during this spare time margin, it is possible to suppress the adverse effects caused by the vibration of the meniscus surface on the next ejection.

However, if the ejection frequency is high, then there is not a sufficient spare margin into which a drive waveform which suppresses the vibration of the meniscus surface is introduced, and hence there are possibilities that the vibration of the meniscus surface has an adverse effect on the next ejection action and it is difficult to achieve the stable ejection.

Furthermore, neither Japanese Patent Application Publication No. 2003-25577 nor Japanese Patent Application Publication No. 2004-306537 takes account of the ejection frequency, and hence the adverse effects on the ejection caused by residual vibration of the meniscus surface are not taken into consideration.

SUMMARY OF THE INVENTION

The present invention is contrived in view of these circumstances, an object thereof being to provide a liquid droplet ejection method and a liquid droplet ejection apparatus for suppressing residual vibration of the meniscus surface and performing stable ejection.

In order to attain the aforementioned object, the present invention is directed to a liquid droplet ejection apparatus comprising: a nozzle from which a liquid droplet is ejected; a pressure chamber filled with liquid to which a pressure is applied in order to eject the liquid in a form of the liquid droplet from the nozzle; and a supply port which supplies the liquid to the pressure chamber, wherein inertance Mn of the nozzle, resistance Rn of the nozzle, compliance Cn of a nozzle section due to surface tension, inertance Ms of the supply port, and resistance Rs of the supply port satisfy the following two formulas:

$$\frac{1}{Mn+Ms}\sqrt{\frac{Mn+Ms}{Cn}-\frac{(Rn+Rs)^2}{4}}>\pi f-\frac{Rn+Rs}{2(Mn+Ms)}\times\frac{1}{f}<\log 0.01.$$

According to this aspect of the present invention, residual vibration of the meniscus surface after ejection can be suppressed, and even when the continuous ejection is performed, it is possible to stabilize the volume of the second ejected liquid droplet. Furthermore, by suppressing the pressure change to 1% or below, it is possible to stabilize the volume of the liquid droplets.

Preferably, the liquid droplet ejection apparatus further comprises a temperature control device which controls a value of a property of the liquid in such a manner that the two formulas are satisfied.

According to this aspect of the present invention, even if there is a change in the temperature of the operating environment, stable ejection is still possible.

In order to attain the aforementioned object, the present invention is also directed to a liquid droplet ejection method comprising the steps of: supplying liquid into a pressure chamber via a supply port; and ejecting the liquid in a form of a liquid droplet from a nozzle connected to the pressure chamber by applying pressure to the liquid in the pressure chamber, wherein inertance Mn of the nozzle, resistance Rn of the nozzle, compliance Cn of a nozzle section due to surface tension, inertance Ms of the supply port, and resistance Rs of the supply port satisfy the following two formulas:

$$\frac{1}{Mn+Ms}\sqrt{\frac{Mn+Ms}{Cn}-\frac{(Rn+Rs)^2}{4}}>\pi f-\frac{Rn+Rs}{2(Mn+Ms)}\times\frac{1}{f}<\log 0.01.$$

According to this aspect of the present invention, the residual vibration of the meniscus surface can be suppressed, and liquid droplets having the stable volume can be continuously ejected.

According to the present invention, residual vibration of the meniscus surface after ejection can be suppressed, and even when the continuous ejection is performed, it is possible to stabilize the volume of the second ejected liquid droplet. Furthermore, by restricting the pressure change to 1% or less, it is possible to stabilize the volume of the liquid droplets.

BRIEF DESCRIPTION OF THE DRAWINGS

The nature of this invention, as well as other objects and benefits thereof, are explained in the following with reference to the accompanying drawings, in which like reference characters designate the same or similar parts throughout the figures and wherein.

DETAILED DESCRIPTION OF THE PREFERRED EMBODIMENTS

Figure 1:
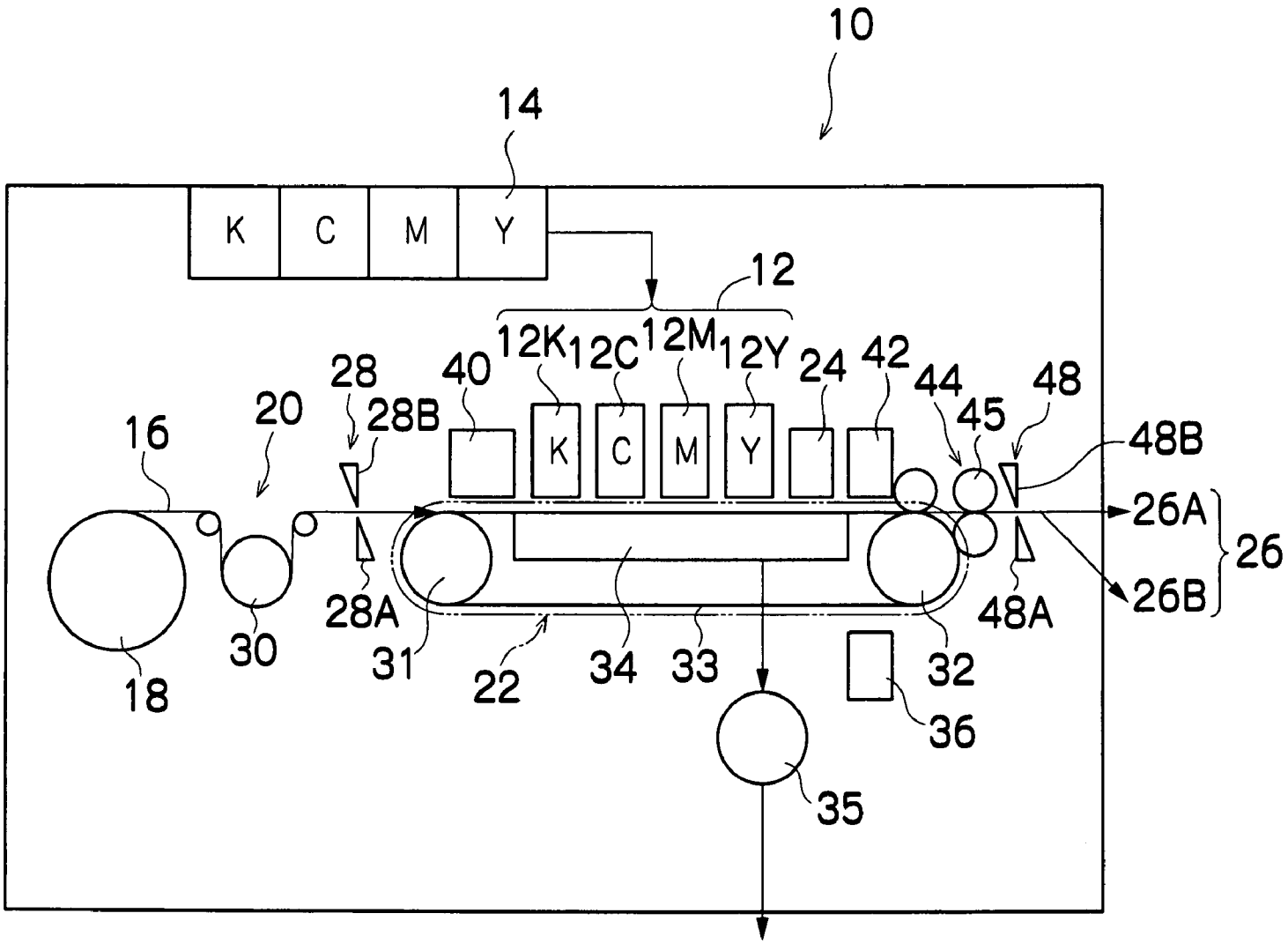
FIG. 1 is a general schematic drawing of an inkjet recording apparatus comprising an inkjet head according to a liquid droplet ejection apparatus relating to an embodiment of the present invention.

FIG. 1 is a general schematic drawing of an inkjet recording apparatus which comprises a liquid droplet ejection apparatus according to an embodiment of the present invention.

As shown in FIG. 1, the inkjet recording apparatus 10 comprises: a print unit 12 including a plurality of print heads (liquid droplet ejection heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown in the drawings) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 in order to improve the cleaning effect.

The inkjet recording apparatus 10 may comprise a roller nip conveyance mechanism instead of the suction belt conveyance unit 22. However, there is a possibility that the image tends to be smeared when the printing area is conveyed by the roller nip action because the nip roller makes contact with the printed surface of the paper immediately after printing. Therefore, the suction belt conveyance in which nothing comes into contact with the image surface in the printing area, as described in the present embodiment, is preferable.

A heating fan 40 is disposed on the upstream side of the printing unit 12 (before the printing unit 12) in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
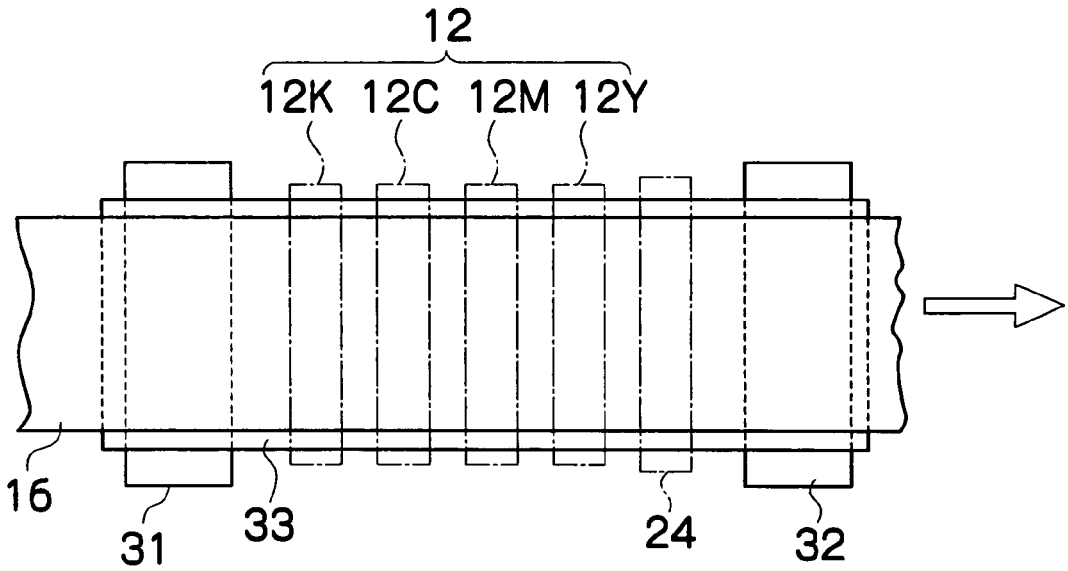
FIG. 2 is a plan view of the principal part of the peripheral area of a print unit in the inkjet recording apparatus illustrated in FIG. 1.

The print unit 12 is a so-called "full line head" in which a line head having a length corresponding to the maximum paper width is arranged in a direction (main scanning direction) that is perpendicular to the paper conveyance direction (sub-scanning direction) (see FIG. 2).

As shown in FIG. 2, the print heads 12K, 12C, 12M and 12Y are constituted by line heads in which a plurality of ink ejection ports (nozzles) are arranged through a length exceeding at least one edge of the maximum size recording paper 16 intended for use with the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while the recording paper 16 is conveyed.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in the direction (main scanning direction) that is perpendicular to the paper conveyance direction.

Here, the terms "main scanning direction" and "sub-scanning direction" are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning action, while the full-line head and the recording paper are moved relatively to each other. The direction in which sub-scanning is performed is called the sub-scanning direction. Consequently, the conveyance direction of the recording paper is the sub-scanning direction and the direction perpendicular to same is called the main scanning direction.

Although a configuration with four standard colors, K C M and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator or the like) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed by the print heads 12K, 12C, 12M, 12Y of respective colors, and detects ink ejection from each head. The ejection determinations include, for example, the presence or absence of ejection, dot size measurement, measurement of the dot landing position, and the like.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is output from the paper output unit 26. The target print (i.e., the result of printing the target image) and the test print are preferably output separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in drawings, the paper output unit 26A for the target prints is provided with a sorter for collecting prints according to print orders.

Figure 3:
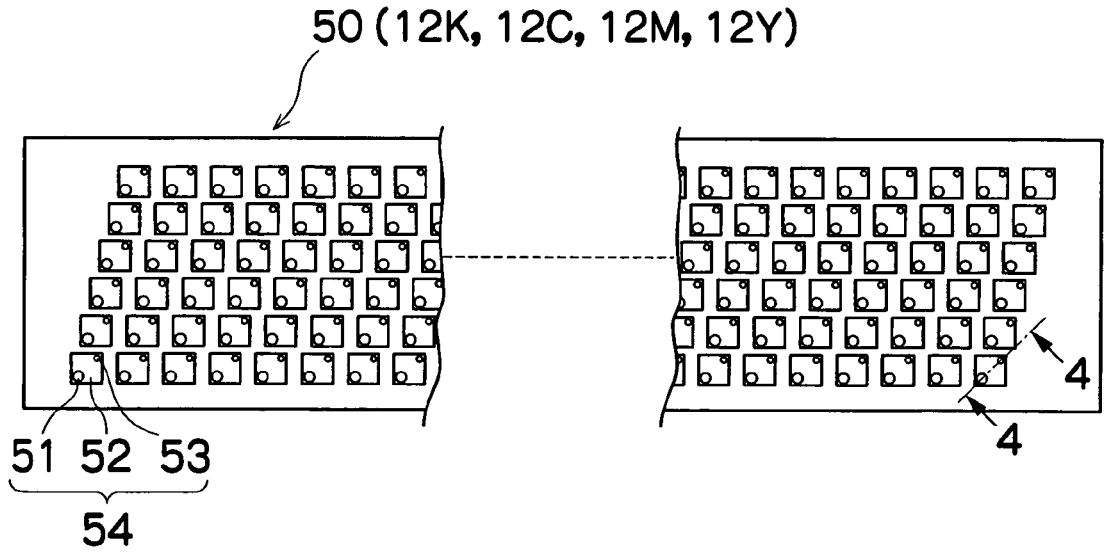
FIG. 3 is a plan perspective diagram showing an embodiment of the structure of a print head.

Next, the arrangement of nozzles (liquid ejection ports) in the print head (liquid ejection head) is described below. The print heads 12K, 12C, 12M and 12Y provided for the respective ink colors have the same structure, and a print head forming a representative embodiment of these print heads is indicated by the reference numeral 50. FIG. 3 shows a plan view perspective diagram of the print head 50.

As shown in FIG. 3, the print head 50 according to the present embodiment achieves a high density arrangement of nozzles 51 by using a two-dimensional staggered matrix array of pressure chamber units 54, each including a nozzle 51 for ejecting ink as ink droplets, a pressure chamber 52 for applying pressure to the ink in order to eject ink, and an ink supply port 53 for supplying ink to the pressure chamber 52 from a common flow channel (not shown in FIG. 3).

There are no particular limitations on the size of the nozzle arrangement in a print head 50 of this kind; as one embodiment, 2400 npi can be achieved by arranging nozzles 51 in 48 lateral rows (21 mm) and 600 vertical columns (305 mm).

In the embodiment shown in FIG. 3, the pressure chambers 52 each have an approximately square planar shape when viewed from above, but the planar shape of the pressure chambers 52 is not limited to a square shape. As shown in FIG. 3, a nozzle 51 is formed at one end of the diagonal of each pressure chamber 52, and an ink supply port 53 is provided at the other end thereof.

Furthermore, although not shown in the drawings, one long full line head may be constituted by combining a plurality of short heads arranged in a two-dimensional staggered array, each of which has pressure chamber units similar to that in FIG. 3 arranged in a two-dimensional matrix configuration, in such a manner that the combined length of this plurality of short heads corresponds to the full width of the print medium.

Figure 4:
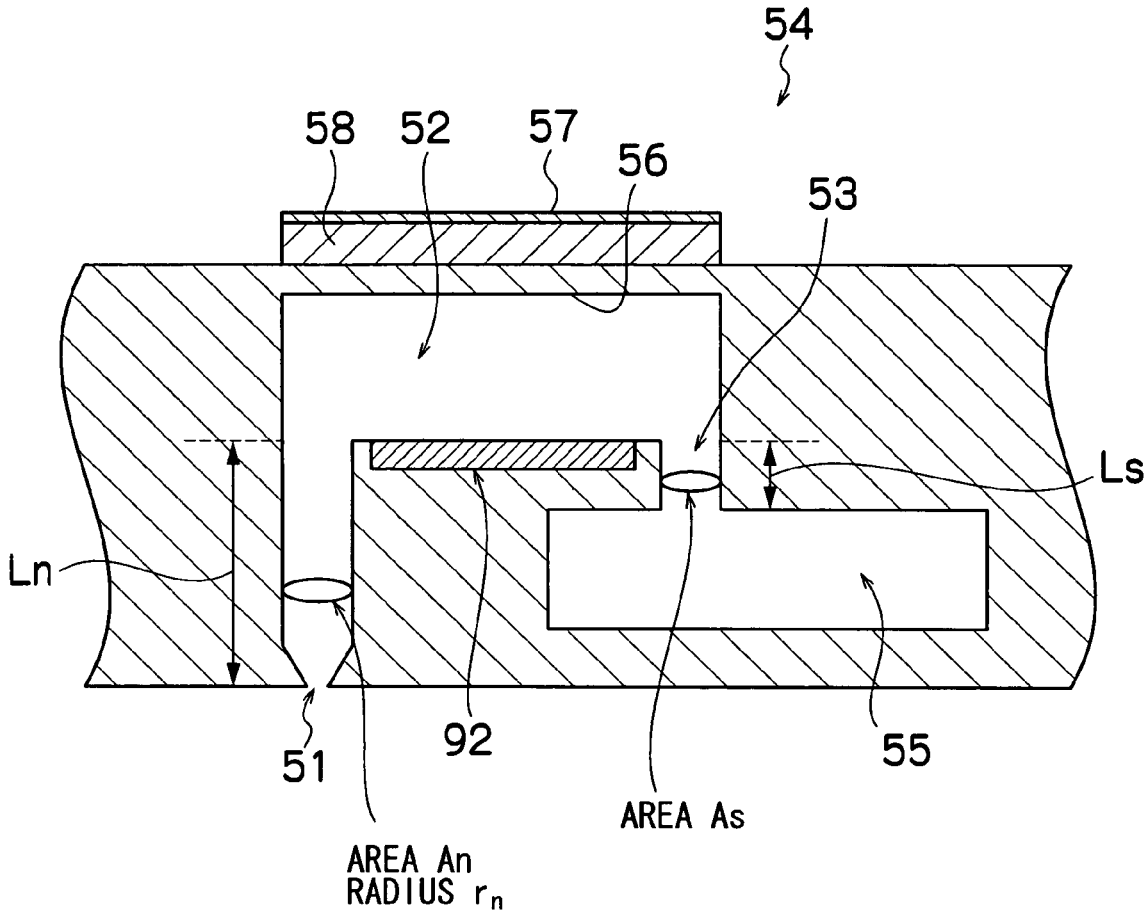
FIG. 4 is a cross-sectional diagram along line 4-4 in FIG. 3.

Furthermore, FIG. 4 shows a cross-sectional diagram along line 4-4 in FIG. 3.

As shown in FIG. 4, each pressure chamber unit 54 is formed by a pressure chamber 52 which is connected to a nozzle 51 that ejects ink, a common flow channel 55 for supplying ink via a supply port 53 is connected to the pressure chamber 52, and one surface of the pressure chamber 52 (the ceiling in the diagram) is constituted by a diaphragm 56. A piezoelectric body 58 which deforms the diaphragm 56 by applying pressure to the diaphragm 56 is bonded to the upper part of same, and an individual electrode 57 is formed on the upper surface of the piezoelectric body 58. Furthermore, the diaphragm 56 also serves as a common electrode.

The piezoelectric body 58 forms a piezoelectric element which is sandwiched between the common electrode (diaphragm 56) and the individual electrode 57, and it deforms when a drive voltage is applied to these two electrodes 56 and 57. The diaphragm 56 is pressed by the deformation of the piezoelectric body (piezoelectric element) 58, in such a manner that the volume of the pressure chamber 52 is reduced and ink is ejected from the nozzle 51. When the voltage applied between the two electrodes 56 and 57 is released, the piezoelectric body 58 returns to its original position, the volume of the pressure chamber 52 returns to its original size, and new ink is supplied into the pressure chamber 52 from the common supply channel 55 via the supply port 53.

Furthermore, as shown in FIG. 4, the pressure chamber 52 is provided with a heater 92 for adjusting the temperature of the ink. This heater 92 adjusts the ink temperature in order to stabilize the ink ejection, by controlling the physical properties, such as the ink density, viscosity, or surface tension. The control techniques are described in more detail below.

Figure 5:
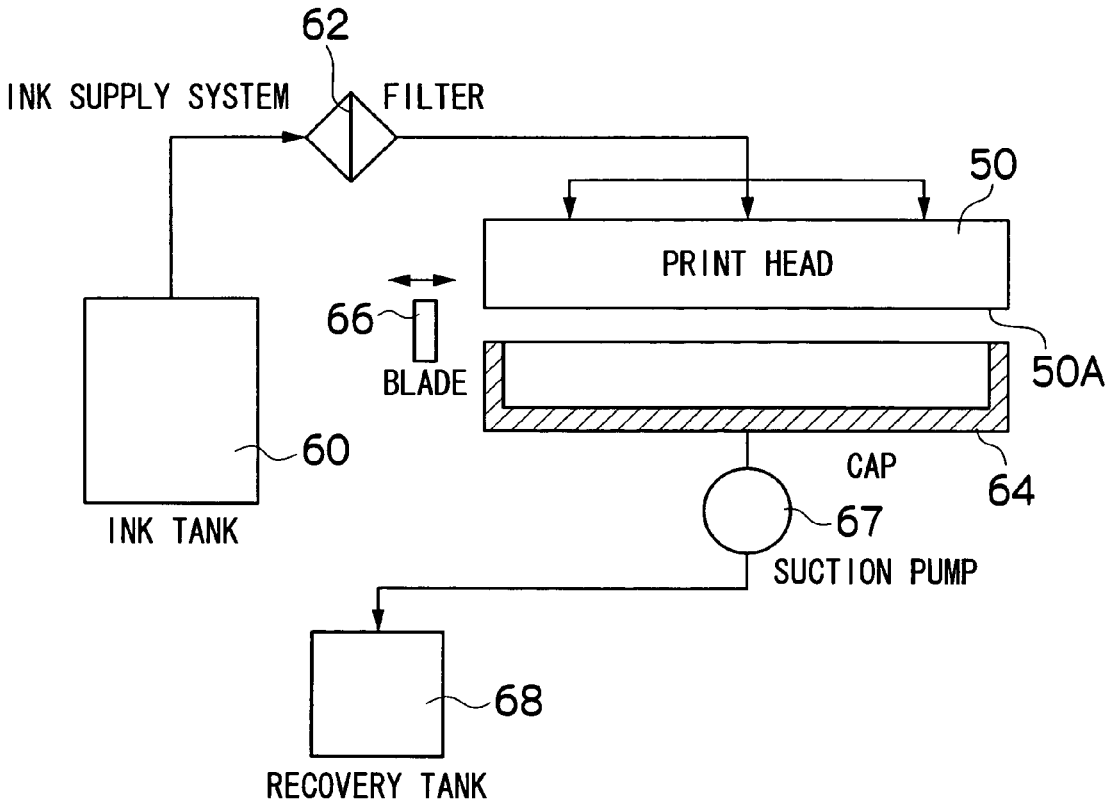
FIG. 5 is a schematic drawing showing the composition of an ink supply system in the inkjet recording apparatus according to an embodiment of the present invention.

FIG. 5 is a schematic drawing showing the configuration of the ink supply system in the inkjet recording apparatus 10. The ink tank 60 is a base tank that supplies ink to the print head 50 and is set in the ink storing and loading unit 14 described with reference to FIG. 1. The types of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. When the ink type is changed in accordance with the intended application, the cartridge type is suitable, and it is preferable to represent the ink type information with a bar code or the like on the cartridge, and to perform ejection control in accordance with the ink type. The ink tank 60 in FIG. 5 is equivalent to the ink storing and loading unit 14 in FIG. 1 described above.

A filter 62 for removing foreign matters and bubbles is disposed in the middle of the channel connecting the ink tank 60 and the print head 50 as shown in FIG. 5. The filter mesh size in the filter 62 is preferably equivalent to or less than the diameter of the nozzle of the print head 50 and commonly about 20 μm.

Although not shown in FIG. 5, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles from drying out and to prevent an increase in the ink viscosity in the vicinity of the nozzles, and a cleaning blade 66 as a device to clean the nozzle face 50A.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced upward and downward in a relative fashion with respect to the print head 50 by an elevator mechanism (not shown). When the power of the inkjet recording apparatus 10 is switched off or when the apparatus is in a standby state for printing, the elevator mechanism raises the cap 64 to a predetermined elevated position so as to come into close contact with the print head 50, and the nozzle region of the nozzle surface 50A is thereby covered by the cap 64.

The cleaning blade 66 is composed of rubber or another elastic member, and can slide on the ink ejection surface (nozzle surface 50A) of the print head 50 by means of a blade movement mechanism (not shown). If there are ink droplets or foreign matter adhering to the nozzle surface 50A, then the nozzle surface 50A is wiped by causing the cleaning blade 66 to slide over the nozzle surface 50A, thereby cleaning same.

During printing or during standby, if the use frequency of a particular nozzle 51 has declined and the ink viscosity in the vicinity of the nozzle 51 has increased, then a preliminary ejection is performed toward the cap 64, in order to remove the ink that has degraded as a result of increasing in viscosity.

Also, when bubbles have become intermixed into the ink inside the print head 50 (the ink inside the pressure chambers 52), the cap 64 is placed on the print head 50, ink (ink in which bubbles have become intermixed) inside the pressure chambers 52 is removed by suction with a suction pump 67, and the ink removed by suction is sent to a recovery tank 68. This suction operation is also carried out in order to suction and remove degraded ink which has hardened due to increasing in viscosity when ink is loaded into the print head for the first time, or when the print head starts to be used after having been out of use for a long period of time.

In other words, when a state in which ink is not ejected from the print head 50 continues for a certain amount of time or longer, the ink solvent in the vicinity of the nozzles 51 evaporates and the ink viscosity increases. In such a state, ink can no longer be ejected from the nozzles 51 even if the pressure generating devices (not illustrated, but described hereinafter) for driving ejection are operated. Therefore, before a state of this kind is reached (while the ink is in a range of viscosity which allows ink to be ejected by means of operation of the pressure generating devices), a "preliminary ejection" is carried out, and thereby the pressure generating devices are operated and the ink in the vicinity of the nozzles, which is of raised viscosity, is ejected toward the ink receptacle. Furthermore, after cleaning away soiling on the surface of the nozzle surface 50A by means of a wiper, such as a cleaning blade 66, provided as a cleaning device on the nozzle surface 50A, a preliminary ejection is also carried out in order to prevent infiltration of foreign matter into the nozzles 51 due to the rubbing action of the wiper. The preliminary ejection is also referred to as "dummy ejection", "purge", "liquid ejection", or the like.

When bubbles have become intermixed into a nozzle 51 or a pressure chamber 52, or when the ink viscosity inside the nozzle 51 has increased over a certain level, ink can no longer be ejected by means of a preliminary ejection, and hence a suctioning action is carried out as follows.

More specifically, when bubbles have become intermixed into the ink inside the nozzles 51 and the pressure chambers 52 or when the ink viscosity inside the nozzle 51 has increased to a certain level or more, ink can no longer be ejected from the nozzles 51 even if the pressure generating devices are operated. In a case of this kind, a cap 64 is placed on the nozzle surface 50A of the print head 50, and the ink containing air bubbles or the ink of increased viscosity inside the pressure chambers 52 is suctioned by a pump 67.

However, this suction action is performed with respect to all of the ink in the pressure chambers 52, and therefore the amount of ink consumption is considerable. Consequently, it is desirable that a preliminary ejection is carried out, whenever possible, while the increase in viscosity is still minor. The cap 64 illustrated in FIG. 5 functions as a suctioning device and it can also function as an ink receptacle for preliminary ejection.

Moreover, desirably, the inside of the cap 64 is divided by means of partitions into a plurality of areas corresponding to the nozzle rows, thereby achieving a composition in which suction can be performed selectively in each of the demarcated areas, by means of a selector, or the like.

Figure 6:
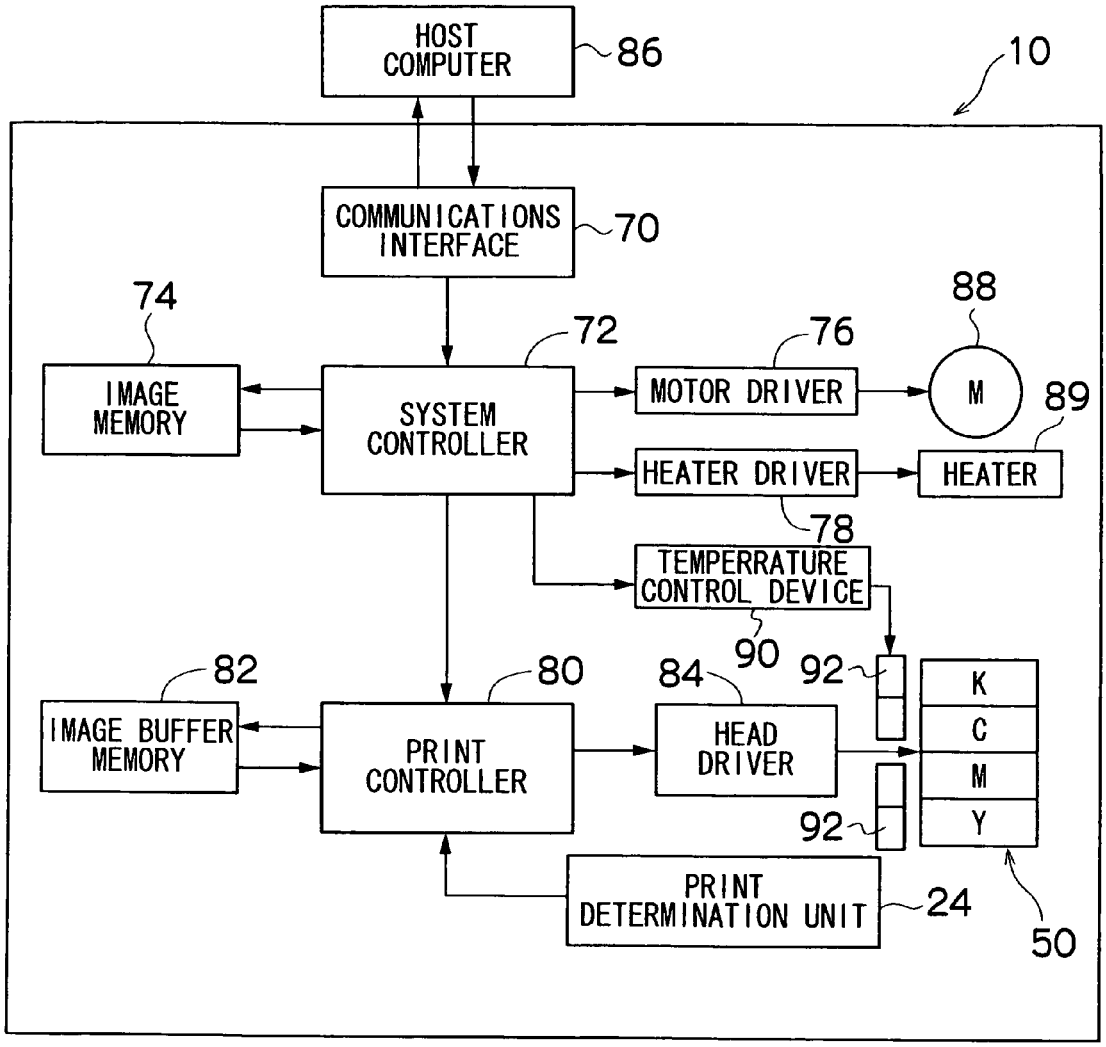
FIG. 6 is a partial block diagram showing the system composition of an inkjet recording apparatus according to an embodiment of the present invention.

FIG. 6 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images input through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, and the like, it also generates a control signal for controlling the motor 88 of the conveyance system and the heater 89.

The motor driver (drive circuit) 76 drives the motor 88 in accordance with commands from the system controller 72. The heater driver 78 drives the heater 89 of the post-drying unit 42, and the like, in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (print data) to the head driver 84. Required signal processing is carried out in the print controller 80, and the ejection amount and the ejection timing of the ink droplets from each of the print heads 50 are controlled via the head driver 84, on the basis of the print data. As a result, desired dot size and dot positions can be achieved.

The print controller 80 is provided with the image buffer memory 82. Image data, parameters, and other data are temporarily stored in the image buffer memory 82 when image data is processed in the print controller 80. The embodiment shown in FIG. 6 is one in which the image buffer memory 82 accompanies the print controller 80; however, the image memory 74 may also serve as the image buffer memory 82.

Also possible is an embodiment in which the print controller 80 and the system controller 72 are integrated to form a single processor.

The head driver 84 drives the pressure generating device of the print head 50 of each color on the basis of print data supplied by the print controller 80. The head driver 84 can be provided with a feedback control system for maintaining constant drive conditions for the print heads.

As shown in FIG. 1, the print determination unit 24 is a block including a line sensor (not illustrated). The print determination unit 24 reads in the image printed onto the recording paper 16, performs various required signal processing operations, and the like, and determines the print situation (presence/absence of ejection, variation in droplet ejection, and the like). The print determination unit 24 supplies these determination results to the print controller 80.

According to requirements, the print controller 80 makes various corrections with respect to the print head 50 on the basis of information obtained from the print determination section 24.

Furthermore, the inkjet recording apparatus 10 according to the present embodiment achieves stable ejection by controlling the ink temperature by means of heaters 92 disposed in the pressure chambers 52 (see FIG. 4), as stated above. A temperature control device 90 which controls each heater 92 is connected to the system controller 72.

Next, the actions according to the present embodiment are described below. In the present embodiment, in order to stabilize ejection by controlling residual vibration of the meniscus surfaces with respect to the nozzles, the resistance and inertance of the nozzles and ink supply ports are set within a range which is determined on the basis of the ejection frequency.

Figure 7:
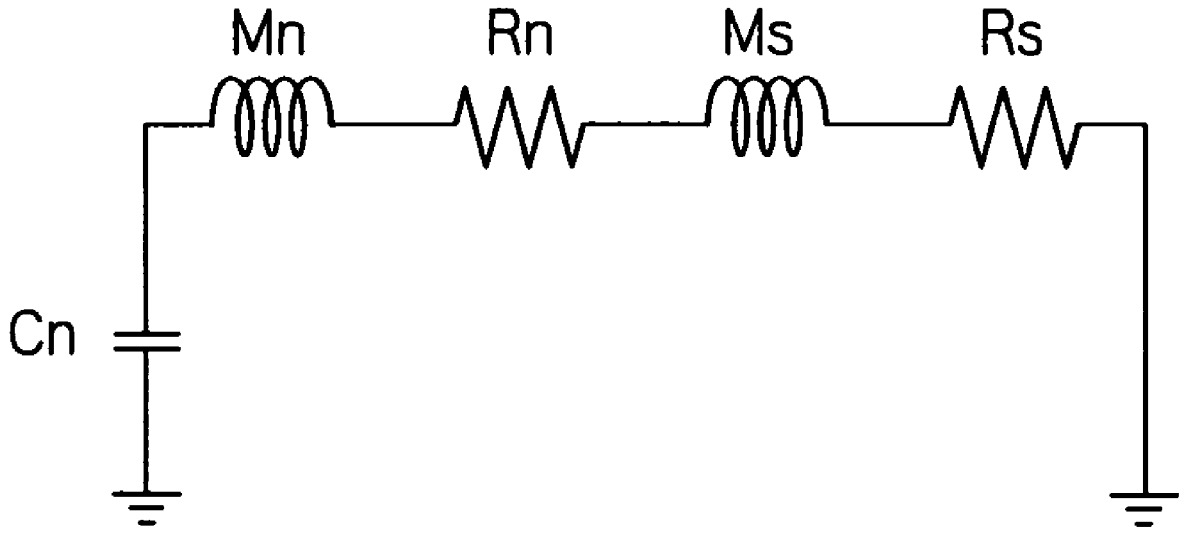
FIG. 7 is a circuit diagram showing a lumped constant model of a pressure chamber unit of a print head according to an embodiment of the present invention.

FIG. 7 shows a lumped constant model relating to one pressure chamber unit 54 of the print head 50 according to the present embodiment. As shown in FIG. 7, this lumped constant model is an LCR circuit in which a coil (L), a capacitor (C) and a resistance (R) are connected together in series.

In FIG. 7, Mn represents the inertance of a nozzle 51, Rn represents the resistance of the nozzle 51, Ms represents the inertance of a supply port 53, Rs represents the resistance of the supply port 53, and Cn represents the compliance in the nozzle section due to surface tension. In FIG. 7, since refilling characteristics are taken directly into consideration, the compliance of the pressure chamber and the compliance of the actuator which do not affect refilling, are omitted and left out of consideration.

Furthermore, as shown in FIG. 4, the length of the nozzle 51 is represented by Ln, the area (cross sectional area) of the nozzle 51 is represented by An, the radius of the nozzle 51 is represented by $r_n$, the length of the supply port 53 is represented by Ls, and the area (cross sectional area) of the supply port 53 is represented by As.

In this case, if the ink density is represented by ρ, the ink viscosity is represented by ν, and the surface tension of the ink is represented by σ, then the inertance Mn of the nozzle, the resistance Rn of the nozzle, the compliance Cn due to the surface tension of the nozzle section, the inertance Ms of the supply port, and the resistance Rs of the supply port, can be expressed respectively as follows.

$$Mn=\rho(Ln/An)$$

$$Rn=8\pi\nu(Ln/An^2)$$

$$Cn=\pi r_n^4/3\sigma$$

$$Ms=\rho(Ls/As)$$

$$Rs=8\pi\nu(Ls/As^2)$$

The condition at which vibration occurs at the meniscus surface during ink refilling indicates a case where the solution becomes a damped (attenuated) vibration solution in the lumped constant model circuit shown in FIG. 7, and this condition is expressed by the following equation (1).

$$4(Mn+Ms)/Cn>(Rn+Rs)^2 \quad (1)$$

On the other hand, in order that, at the end of refilling, the meniscus surface reverts to its original state and hardly vibrates at all, it is necessary to satisfy the following two conditions (A) and (B):

(A) the frequency of the vibration solution of the damped vibration solution is equal to or less than one half of the ejection frequency; and (B) the damped term (attenuation term) of the damped vibration solution has a value of 0.01 or less, when a time period equivalent to the ejection cycle has passed.

The condition (B) stated above, in which the value becomes equal to or less than 0.01 (1%), is based on the following reasons.

Namely, if an image is printed by a "one pass" method, in which the print head 50 and the recording paper 16 are moved relatively to each other once (in the sub-scanning direction), then it is necessary to suppress the variation in the liquid droplet size to 3% or less.

Figure 8:
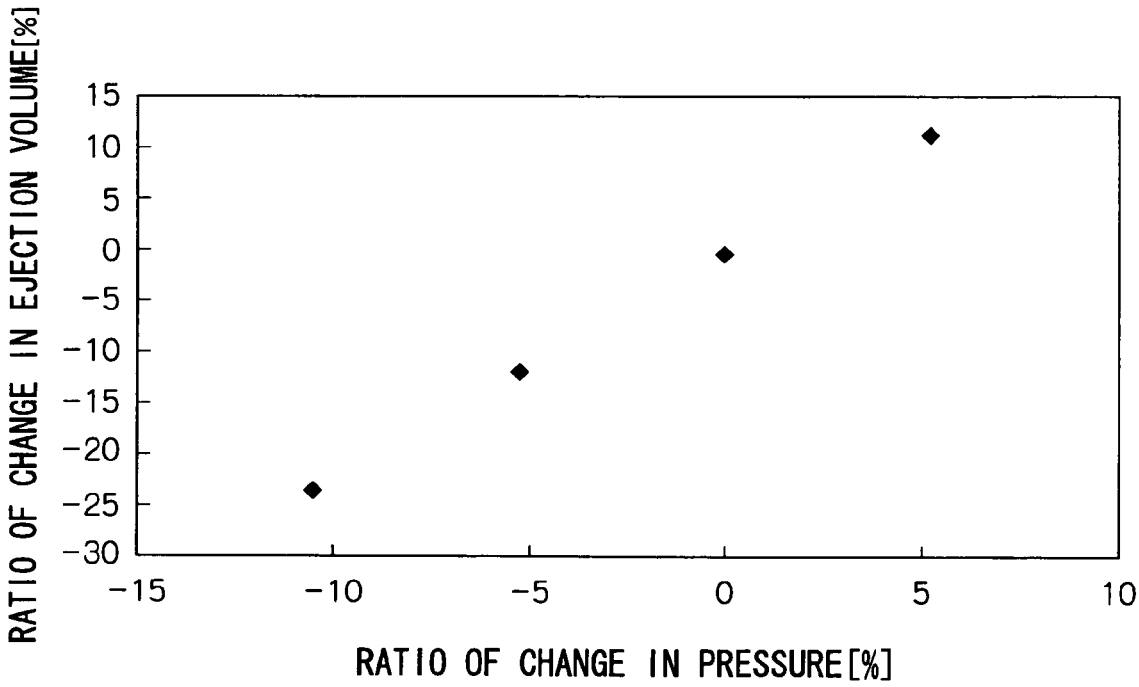
FIG. 8 is a graph showing the relationship between the ratio of change in the pressure and the ratio of change in the ejection volume.

FIG. 8 shows a graph in which the horizontal axis represents the ratio of change in the pressure amplitude which varies on the basis of the pressure variation conditions in a case where an ink droplet of 2 μl (picoliters) or less is ejected, and the vertical axis represents the ratio of change of the ejection volume which varies in accordance with the ratio of change in the pressure amplitude.

As shown in FIG. 8, this graph traces a substantially straight line, and the amount of change is about 20-25% with respect to a pressure variation of 10%. According to this, it can be deduced that the ejection volume changes by 2-3% in response to a pressure variation of 1%.

Consequently, it can be considered that, if the amount of change in the pressure is less than 1% with respect to the initial ejection conditions, then the variation in the size of the liquid droplet is within a tolerable range. Therefore, the amount of damping (attenuation) is preferably adjusted to be 0.01 or less.

In order to satisfy the two conditions (A) and (B) stated above, it is necessary to satisfy the following two equations, Formula (2) and Formula (3).

$$\frac{1}{Mn+Ms}\sqrt{\frac{Mn+Ms}{Cn}-\frac{(Rn+Rs)^2}{4}}>\pi f \quad (2)$$

$$-\frac{Rn+Rs}{2(Mn+Ms)}\times\frac{1}{f}<\log 0.01 \quad (3)$$

In Formula (2) and Formula (3) stated above, f represents the ejection frequency, and the log represents the natural logarithm.

If these conditions are satisfied, it is possible to perform stable ejection at all times even when the ejection is performed at the ejection frequency of f. More specifically, even if a subsequent droplet is ejected after ejecting a previous droplet at the ejection frequency of f under the conditions of Formula (2) and Formula (3), the meniscus surface is stabilized and consequently the second liquid droplet which is equivalent to the first droplet can be ejected. In this way, it is possible to perform stable ejection at all times.

If Formula (2) and Formula (3) are satisfied, then Formula (1) stated above is also satisfied, automatically.

In this way, by satisfying Formulas (2) and (3), the residual vibration of the meniscus surface is suppressed and ejection can be stabilized. The control for satisfying the aforementioned conditions can be implemented, by regulating the temperature of the ink to a prescribed range, for example. More specifically, the ink temperature is restricted to being within a prescribed range, by controlling the heater 92 provided at each of the pressure chambers 52 by means of the system controller 72 and the temperature control devices 90.

According to this control, the ink temperature is determined by means of a temperature sensor (not shown) which is provided in each of the pressure chambers 52; values of the nozzle inertance Mn, the nozzle resistance Rn, the compliance Cn caused by the surface tension in the nozzle section, the supply port inertance Ms, the supply port resistance Rs, and the like, are calculated on the basis of the values of the ejection frequency f, the nozzle diameter, the nozzle length, the nozzle area, the supply port length, the supply port area, and the like; and these calculated values are inserted into the above Formulas (2) and (3) in order to determine whether Formulas (2) and (3) are established or not.

The heaters 92 which adjust the ink temperature are provided inside the pressure chambers 52 in the embodiment described above; however, the situation of the heaters 92 is not limited to being inside the pressure chambers 52, and it is possible to situate the heaters in any desired location of the ink supply system.

As described above, according to the present embodiment, the inertance and resistance values of the nozzles and supply ports are designed on the basis of the ejection frequency, and the ink temperature adjusted accordingly. Therefore, the residual vibration of the meniscus surface is suppressed, and it is possible to perform the second ejection under substantially the same state as the first ejection.

The liquid droplet ejection method and the liquid droplet ejection apparatus according to embodiments of the present invention have been described in detail above, but the present invention is not limited to the aforementioned embodiments, and it is possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid droplet ejection apparatus comprising:

a nozzle from which a liquid droplet is ejected;

a print controller for driving the liquid droplet ejection apparatus at an ejection frequency of f;

a pressure chamber filled with liquid to which a pressure is applied in order to eject the liquid in a form of the liquid droplet from the nozzle; and a supply port which supplies the liquid to the pressure chamber, wherein inertance Mn of the nozzle, resistance Rn of the nozzle, compliance Cn of a nozzle section due to surface tension, inertance Ms of the supply port, and resistance Rs of the supply port satisfy the following two formulas:

$$\frac{1}{Mn+Ms}\sqrt{\frac{Mn+Ms}{Cn}-\frac{(Rn+Rs)^2}{4}}>\pi f-\frac{Rn+Rs}{2(Mn+Ms)}\times\frac{1}{f}<\log 0.01.$$

2. The liquid droplet ejection apparatus as defined in claim 1, further comprising a temperature control device which controls a value of a property of the liquid in such a manner that the two formulas are satisfied.

3. A liquid droplet ejection method comprising the steps of:

supplying liquid into a pressure chamber via a supply port;

driving the pressure chamber at an ejection frequency of f; and ejecting the liquid in a form of a liquid droplet from a nozzle connected to the pressure chamber by applying pressure to the liquid in the pressure chamber, wherein inertance Mn of the nozzle, resistance Rn of the nozzle, compliance Cn of a nozzle section due to surface tension, inertance Ms of the supply port, and resistance Rs of the supply port satisfy the following two formulas:

$$\frac{1}{Mn+Ms}\sqrt{\frac{Mn+Ms}{Cn}-\frac{(Rn+Rs)^2}{4}}>\pi f-\frac{Rn+Rs}{2(Mn+Ms)}\times\frac{1}{f}<\log 0.01.$$

* * * * *